US010221029B2

(12) United States Patent
Van Laar

(10) Patent No.: US 10,221,029 B2
(45) Date of Patent: Mar. 5, 2019

(54) DEFLECTION ROLLER, USE OF SAID DEFLECTION ROLLER AND TIRE BUILDING MACHINES COMPRISING SAID DEFLECTION ROLLER

(71) Applicant: VMI Holland B.V., Epe (NL)

(72) Inventor: Gerardus Johannes Catharina Van Laar, Epe (NL)

(73) Assignee: VMI HOLLAND B.V. (NL)

( * ) Notice: Subject to any disclaimer, the term of this patent is extended or adjusted under 35 U.S.C. 154(b) by 0 days.

(21) Appl. No.: 15/567,349

(22) PCT Filed: Mar. 18, 2016

(86) PCT No.: PCT/NL2016/050193
§ 371 (c)(1),
(2) Date: Oct. 17, 2017

(87) PCT Pub. No.: WO2016/167643
PCT Pub. Date: Oct. 20, 2016

(65) Prior Publication Data

US 2018/0111778 A1 Apr. 26, 2018

(30) Foreign Application Priority Data

Apr. 17, 2015 (NL) ..... 2014655

(51) Int. Cl.
*B65H 20/24* (2006.01)
*B65H 27/00* (2006.01)

(52) U.S. Cl.
CPC ..... *B65H 27/00* (2013.01); *B65H 20/24* (2013.01); *B65H 2404/1151* (2013.01); *B65H 2801/93* (2013.01)

(58) Field of Classification Search
CPC .... B65H 27/00; B65H 20/24; B65H 2801/93; B65H 2404/1151
See application file for complete search history.

(56) References Cited

U.S. PATENT DOCUMENTS 1,616,363 A 11/1924 Gammeter
3,840,224 A * 10/1974 Zawiski ..... B65H 5/062 271/263

FOREIGN PATENT DOCUMENTS

DE 20 2010 016 554 4/2011 ..... B65H 27/00
DE 10 2010 053 397 6/2012 ..... B65H 27/00
(Continued)

OTHER PUBLICATIONS

International Search Report and Written Opinion issued in corresponding PCT Appln. Serial No. PCT/NL2016/050193 dated Jun. 27, 2016, 9 pgs.
(Continued)

*Primary Examiner* — William E Dondero
(74) *Attorney, Agent, or Firm* — Hayes Soloway P.C.

(57) ABSTRACT

A deflection roller for guiding and/or deflecting a rubber tire component, has a shaft that defines an axis of rotation of the deflection roller and a plurality of bristles distributed circumferentially around the shaft and extending radially outwards and orthogonally with respect to the axis of rotation to form a circumferential brush surface that is concentric to the axis of rotation. The deflection roller further has a first boundary element and a second boundary element extending adjacent to the plurality of bristles in an axial direction parallel to the axis of rotation and protruding radially outside the circumferential brush surface at a first end and a second end of the circumferential brush surface, respectively, for binding the circumferential brush surface in the axial direction.

20 Claims, 6 Drawing Sheets

(56) References Cited

FOREIGN PATENT DOCUMENTS

| | | | | |
|---|---|---|---|---|
| DE | 10 2010 055 168 | 6/2012 | ..... | B65H 27/00 |
| GB | 1 543 523 | 4/1979 | ..... | B65G 39/10 |
| WO | WO 2011/010216 | 1/2011 | ..... | B65H 54/78 |

OTHER PUBLICATIONS

International Preliminary Report on Patentability issued in corresponding PCT Appln. Serial No. PCT/NL2016/050193 dated Feb. 24, 2017, 6 pgs.

* cited by examiner

DEFLECTION ROLLER, USE OF SAID DEFLECTION ROLLER AND TIRE BUILDING MACHINES COMPRISING SAID DEFLECTION ROLLER

BACKGROUND

The invention relates to a deflection roller for guiding and/or deflecting a rubber tire component, in particular a rubber tire component comprising reinforcement cords. The invention further relates to the use of said deflection roller in various tire building machines and the tire building machines comprising said deflection roller.

Known deflection rollers are used in various tire building applications to guide rubber tire components from one point or station to another point or station, for example via an intermediate festooner. The known deflection rollers comprise a solid circumferential surface for contacting and guiding the tire component. An application for said known deflection rollers in the field of tire building is the use of the deflection rollers in a festooner, wherein the distance between the deflection rollers can be varied to increase or decrease the capacity of the festooner. A continuous length of a rubber tire component is fed into the festooner and zigzags between the plurality of deflection rollers before exiting the festooner at a discharge side. At each deflection roller, the tire component contacts a substantial part of the circumferential surface of the deflection roller, resulting in relatively high friction forces between the rubber of the tire component and circumferential surface which can make it hard to correct any misalignment of the tire component with respect to the center of the deflection roller. The tire component can be seriously deformed when it eventually contacts or runs over the side of the deflection roller.

To ensure that the tire component remains centered with respect to the deflection roller, the circumferential surfaces of known deflection rollers are often crowned. The increased circumferential length at top of the crown automatically centers the tire component with respect to the deflection roller. However, the increased circumferential length at the top of the crown has the disadvantage that it causes uneven stretching of the tire component, which in particular for cord reinforced tire components causes permanent waving in the length of the cord reinforced tire component.

It is an object of the present invention to provide a deflection roller, the use of said deflection roller in various tire building machines and tire building machines comprising said deflection roller, wherein the aforementioned drawback of the known deflection roller can be at least partly resolved.

SUMMARY OF THE INVENTION

According to a first aspect, the invention provides a deflection roller for guiding and/or deflecting a rubber tire component, wherein the deflection roller comprises a shaft that defines an axis of rotation of the deflection roller and a plurality of bristles distributed circumferentially around the shaft and extending radially outwards and orthogonally, substantially orthogonally or in a neutral orientation (e.g. each bristle extending in a plane extending at a right angle to the axis of rotation) with respect to the axis of rotation to form a circumferential brush surface that is concentric to the axis of rotation, wherein the deflection roller further comprises a first boundary element and a second boundary element extending adjacent to the plurality of bristles in an axial direction parallel to the axis of rotation and protruding radially outside the circumferential brush surface at a first end and a second end of the circumferential brush surface, respectively, for binding the circumferential brush surface in the axial direction.

DE 10 2010 055 168 A1 discloses a deflection roller for flattening a paper sheet. For this purpose, the known deflection roller is provided with bristles which are divided into sections along the axial direction. The central sections are provided with bristles having no inclination in the axial direction, while the bristles in the sections towards the axially outer ends of the deflection roller have an increasingly outwardly orientated inclination. As a result, the lateral forces that are exerted by the bristles onto the paper sheet increase towards the respective axially outer ends. DE 10 2010 055 168 A1 specifies that normally, there is no relative displacement of the path of the material with respect to the bristles. According to DE 10 2010 055 168 A1, any such movements would have a negative impact on the optical and/or mechanical properties of the material. However, DE 10 2010 053 397 A1, which seems to relate to the same deflection roller, acknowledges that—when the neutral central sections fail—objects on the deflection roller will be pulled axially outwards uncontrollably.

One skilled in the art would not consider using the deflection roller of DE 10 2010 055 168 A1 for guiding and/or deflecting tire components. Firstly, the tire components normally do not require stretching in the axial direction. Secondly, when the tire components would move axially off-center, they would be forced outwards uncontrollably, which is a potentially very hazardous and undesirable situation. Although flanges are disclosed in U.S. Pat. No. 1,616,363 A in combination with a solid circumferential surface, it is extremely unwise to combine those flanges with the outwardly orientation bristles of the deflection roller of DE 10 2010 055 168 A1, as the tire component would simply be forced uncontrollably up and over the edges of the flanges, resulting in considerably stretching, deformation and damage to the tire component.

It is noted that the orthogonal orientation of the bristles with the boundary elements according to the invention solve the aforementioned problems. Due to their orthogonal orientation, the bristles are more or less neutral with respect to the tire component in the axial direction. The plurality of bristles can in combination support the rubber tire component around the circumferential brush surface, while the bristle can individually allow movement of the rubber tire component in the axial direction of the deflection roller. In particular, the individual bristles can considerable reduce or even eliminate friction between the circumferential brush surface and the rubber tire component in the axial direction. Once the rubber tire component comes into contact with one of the boundary elements, the one boundary element can stop and/or reverse the axial movement of the rubber tire component with a minimal reaction force, thereby ensuring that the rubber tire component remains contained on the circumferential brush surface between the respective boundary elements. The deflection roller can thus effectively correct misalignment without causing considerable friction between the circumferential brush surface and the rubber tire component. There is no need for creating a crowned cross sectional profile, as in the prior art, that could potentially cause uneven stretching and/or deformation in the rubber tire component or its embedded reinforcement cords.

The invention thus fully departs from the teachings of many prior arts that the tire component should be centered on the roller and instead allows for movement of the tire component in the axial direction, which movement can be easily corrected due to the carefully chosen combination of boundary elements and neutrally oriented bristles.

In an embodiment the bristles extend in a substantially neutral orientation that does not actively steer the rubber tire component in an axial direction parallel to the axis of rotation. Unlike DE 10 2010 055 168 A1, the neutral orientation of the plurality of bristles does not force the tire component uncontrollably in any axial direction. Hence, the neutrally oriented bristles do not exert any considerable lateral forces onto the tire component, such that they can be used in combination with the boundary elements for successfully stopping and reversing an axial movement of the tire component.

In an embodiment the deflection roller comprises a bristle holder for holding and positioning the plurality of bristles with respect to the shaft, wherein the plurality of bristles are mounted orthogonally or substantially orthogonally to the bristle holder. The bristle holder can thus hold the plurality of bristles in a specific configuration with respect to the shaft.

In an embodiment the bristles of the plurality of bristles are flexible, resilient or resiliently flexible. Each bristle can therefore move or flex with the rubber tire component in the axial direction while the respective bristle is in contact with the rubber tire component, while returning to its original, unflexed state after the respective bristle is no longer in contact with the rubber tire component.

In an embodiment the circumferential brush surface is straight cylindrical and/or has a constant or substantially constant diameter in the axial direction. Because there is no need to keep the rubber tire component aligned, one does not need to provide the deflection roller with a crowned circumferential brush surface. The absence of the crowning can reduce uneven stretching of the rubber tire component and in particular the reinforcement cords embedded in the rubber tire component. The result can be a more uniform and less wavy rubber tire component.

In an embodiment all bristles of the plurality of bristles have the same or substantially the same length. Thus, all bristles can be mounted in the same manner and can be distributed around the deflection roller to form the circumferential brush surface.

In an embodiment the first boundary element and the second boundary element comprise a first boundary surface and a second boundary surface, respectively, protruding radially outside the circumferential brush surface in an upright or substantially upright orientation with respect to the circumferential brush surface. The first boundary surface and the second boundary surface can contain the rubber tire component on the circumferential brush surface by preventing the rubber tire component from running over the edge of the deflection roller.

In an embodiment the first boundary surface and the second boundary surface extend circumferentially and/or concentrically with respect to the circumferential brush surface. The first boundary surface and the second boundary surface can therefore contain the rubber tire component at any position along the circumference of the circumferential brush surface.

In an embodiment the first boundary element and the second boundary element comprise a first disc forming the first boundary surface and a second disc forming the second boundary surface, respectively, each disc having a circumferential edge extending concentrically with respect to and radially outside of the circumferential brush surface. The circumferential edges can prevent the rubber tire component from running over the edge of the deflection roller.

In an embodiment the first boundary element and the second boundary element protrude radially outside the circumferential brush surface over a distance that is at least equal to the thickness of the rubber tire component which the deflection roller is arranged to guide and/or deflect. Preferably, the first boundary element and the second boundary element protrude radially outside the circumferential brush surface over at least ten millimeters, preferably at least twenty millimeters and most preferably at least thirty millimeters.

In an embodiment the first boundary element and the second boundary element are mounted to the shaft. The first boundary element and the second boundary element can thus be supported on and reliably positioned with respect to the shaft.

In an embodiment the bristle holder is mounted to and extends between the first boundary element and the second boundary element in a position radially outside or spaced apart from the shaft. The bristle holder can therefore be indirectly mounted to the shaft via the bristle holder. In particular in the event that the bristle holder is radially spaced apart from the shaft, the bristles themselves do not have to be as long as they would have to be when they originated from the shaft, while still forming the circumferential brush surface at a given outer diameter. Reducing the lengths of the bristles can improve their ability to reliably and/or stably support the rubber tire component around the deflection roller.

In an embodiment the shaft is a hollow shaft or a tube. The hollow shaft or tube can be mounted to an external shaft, e.g. a shaft of a tire building machine.

According to a second aspect, the invention provides a tire building machine comprising the aforementioned deflection roller. The incorporation or implementation of the deflection roller in a tire building machine is particularly advantageous as it can reduce the deformation and/or uneven stretching of a rubber tire component upstream, downstream and in said tire building machine.

In a first embodiment thereof, the tire building machine comprises a festooner, wherein festooner comprises a plurality of said deflection rollers. In particular in situations when the capacity of the festooner is increased or decreased, the rubber tire component can be subjected to various forces that could potentially cause the rubber tire component to run out of alignment. The use of a plurality of said deflection rollers in a festooner can be particularly advantageous as the plurality of deflection rollers can automatically correct the running out of alignment of the rubber tire component, without causing permanent stretching and/or deformation of the rubber tire component or the reinforcement cords embedded in the rubber tire component. In particular the occurrence of waving as a result of uneven stretching of the reinforcement cords in the longitudinal direction of the rubber tire component can be reduced or prevented.

In a second embodiment thereof, the tire building machine comprises a dancer roller assembly, wherein the deflection roller is a dancer roller of said dancer roller assembly. A dancer roller is typically used in tire building applications just upstream of a station where abrupt changes in the feeding velocity of the rubber tire component are required to accommodate an intermittent process, e.g. at a cutting station where lengths of the rubber tire component are fed onto a cutting table and cut into smaller pieces. The deflection roller in its function as dancer roller can rapidly move with respect to a set of stationary rollers to briefly accumulate a length of the rubber tire component in a loop between the stationary rollers before feeding it downstream.

The rapid movement can cause running out of alignment of the rubber tire component with respect to the deflection roller, which can be corrected by the deflection roller without serious deformation and/or uneven stretching of the rubber tire component.

Preferably, the dancer roller assembly comprises guides, wherein the deflection roller is slidable along the guides in a dancing direction, wherein the deflection roller is tiltable about a tilting axis that extends perpendicular to the axis of rotation and perpendicular to the dancing direction. The tilting of the deflection roller can compensate for asymmetries, tilting, warping and/or uneven tensions in the rubber tire component during the up and down movement of the deflection roller in the dancing direction.

According to a third aspect, the invention provides a use of the aforementioned deflection roller in one of the aforementioned tire building machines for guiding and/or deflecting a rubber tire component from a first direction of conveyance to a second direction of conveyance which is different from the first direction of conveyance, while containing the rubber tire component on the circumferential brush surface between the first boundary element and the second boundary element. By containing the rubber tire component between the boundary elements, it can be prevented that the rubber tire component runs over the edge of the deflection roller. As mentioned before, the correction can be performed without the deflection roller inflicting serious deformation and/or uneven stretching on the rubber tire component.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached schematic drawings, in which.

DETAILED DESCRIPTION OF THE INVENTION

Figure 1:
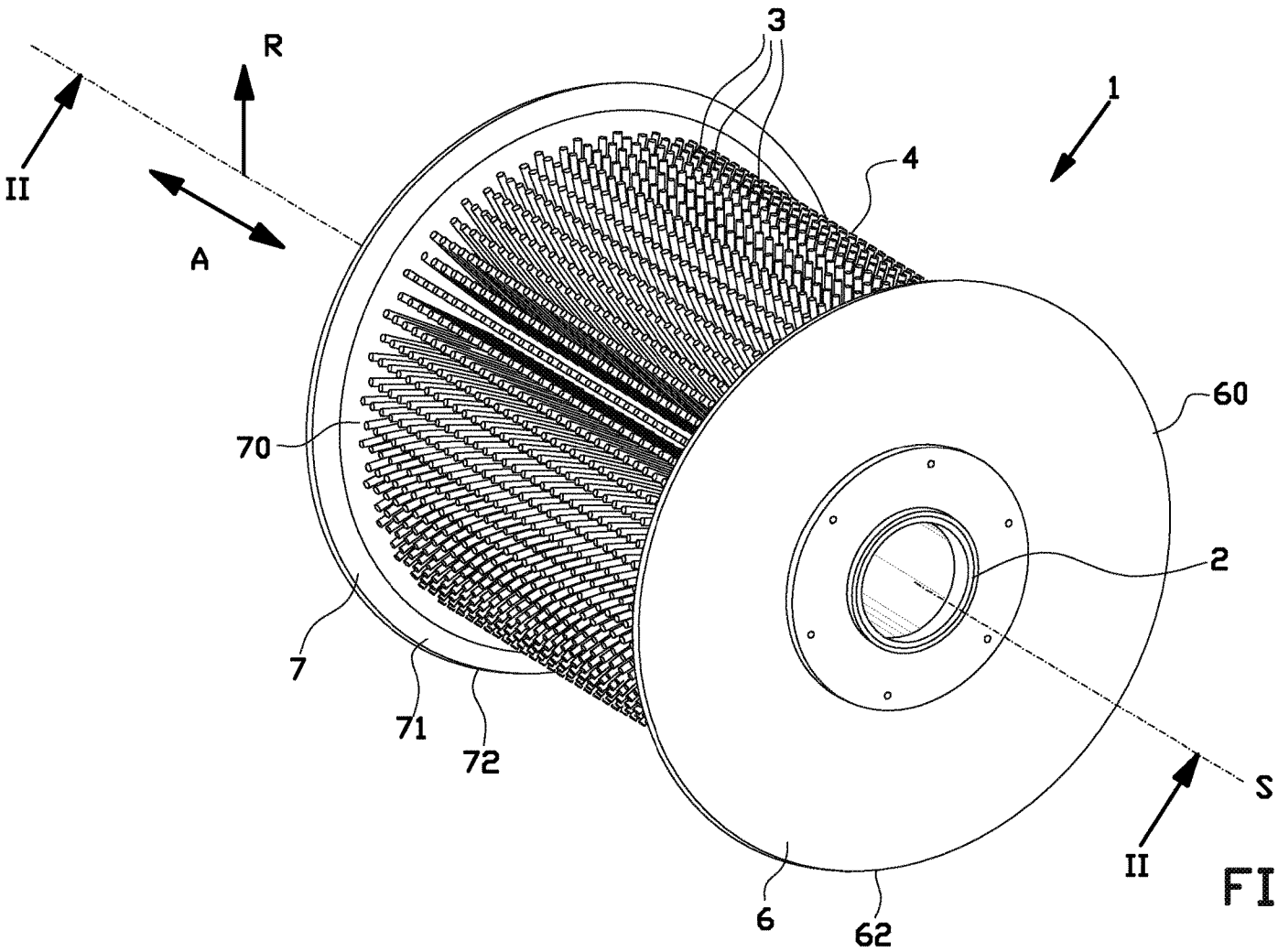
FIG. 1 shows an isometric view of a deflection roller according to the invention.
Figure 2:
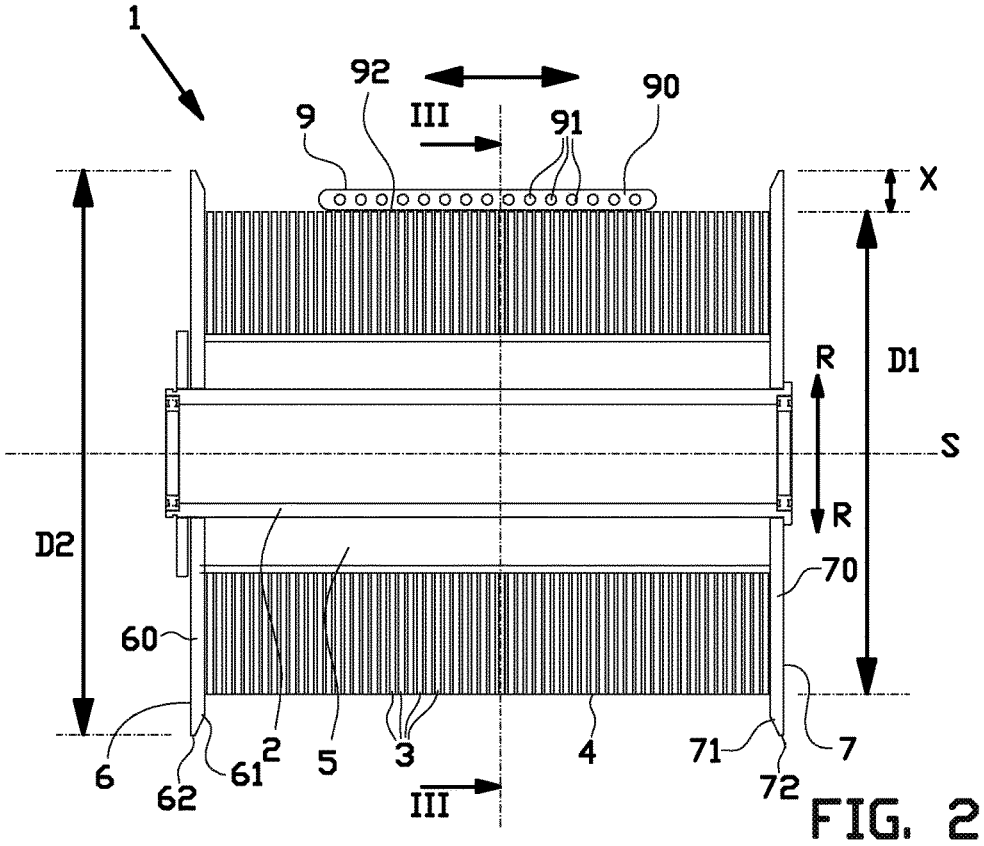
FIG. 2 shows a cross section of the deflection roller according to the line II-II in FIG. 1.
Figure 3:
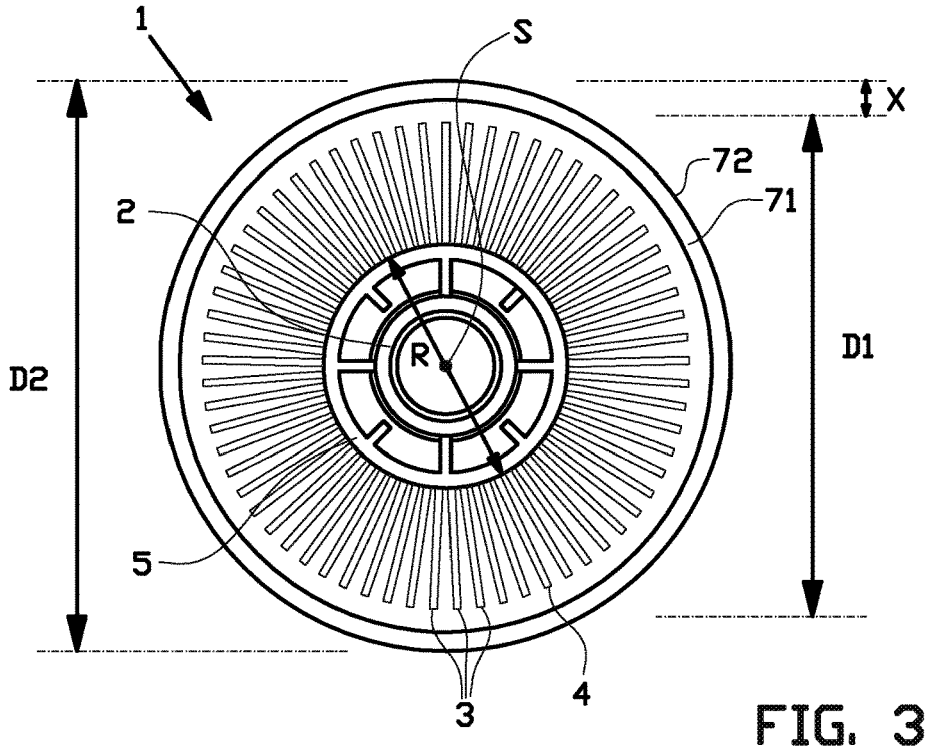
FIG. 3 shows a cross section of the deflection roller according to the line III-III in FIG. 2.
Figure 4:
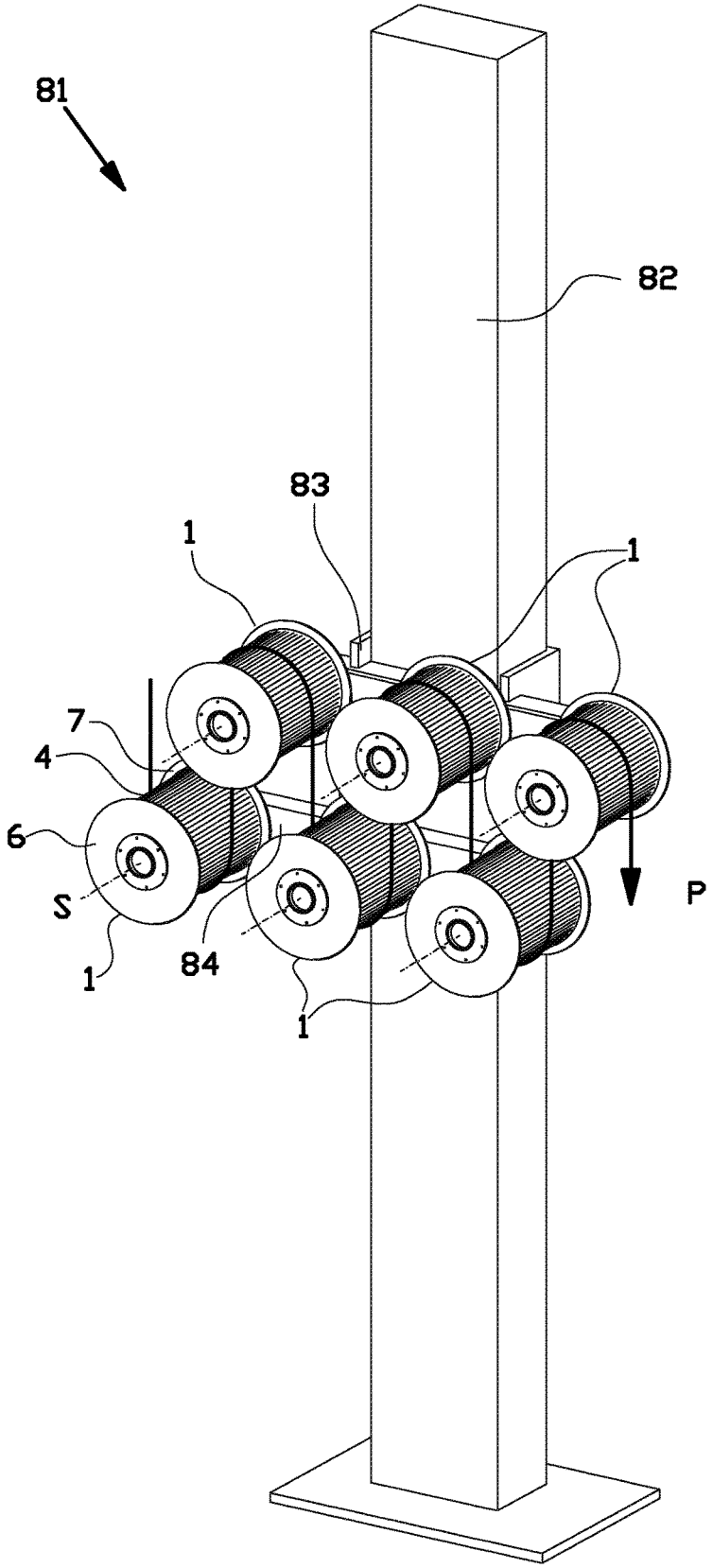
FIG. 4 shows a first tire building machine, in particular a festooner, with a plurality of the deflection rollers according to FIG. 1.
Figure 5:
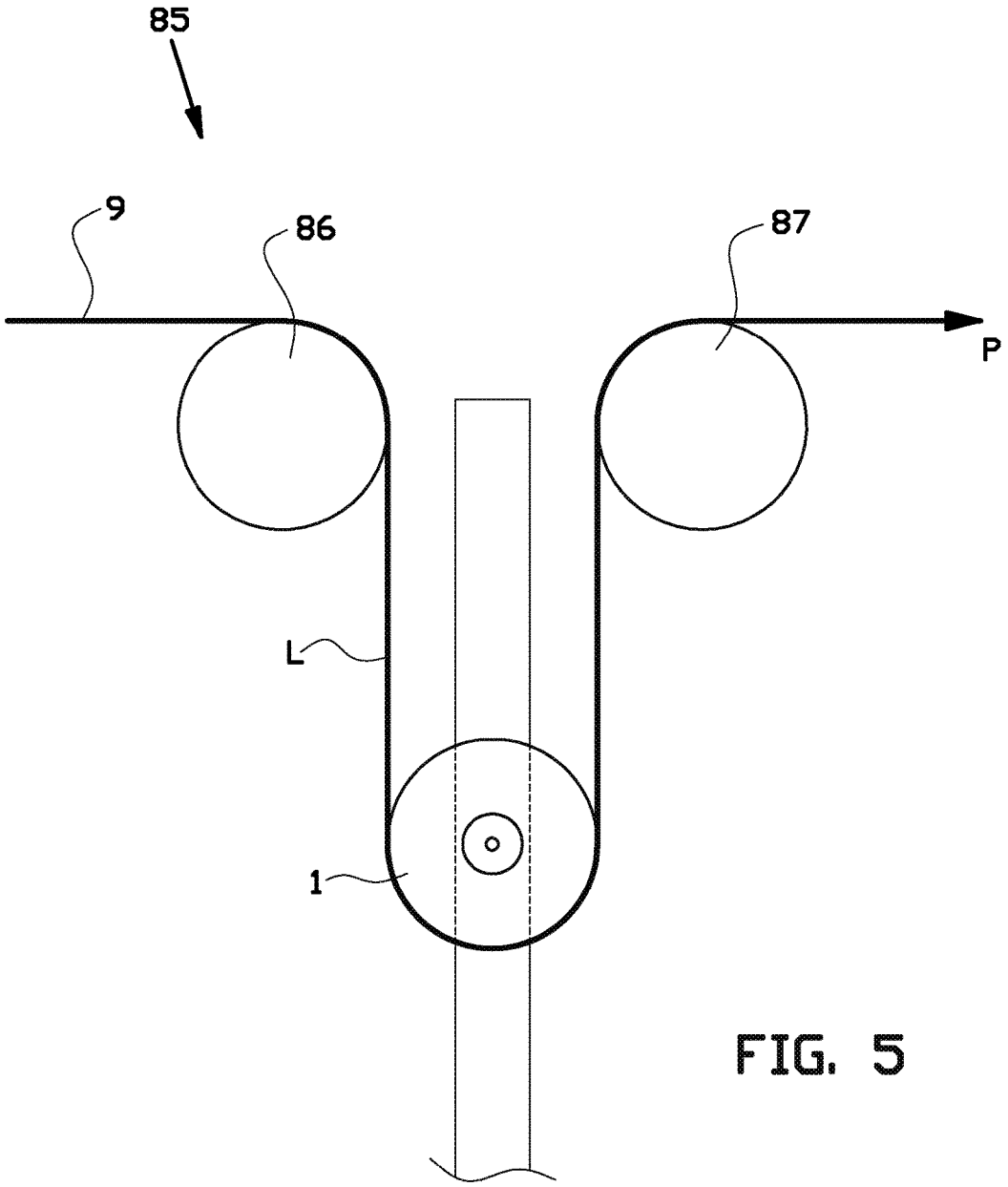
FIG. 5 shows a second tire building machine, in particular a dancer roller assembly with the deflection roller according to FIG. 1.

FIGS. 1, 2 and 3 show a deflection pulley or a deflection roller 1 according to the invention. The deflection roller 1 can be applied, implemented or used in various tire building machines for guiding and/or deflecting a rubber tire component 9. FIG. 4 show an exemplary use of a plurality of the deflection rollers 1 according to FIGS. 1-3 in a festooner 81. FIG. 5 shows an alternative exemplary use of the deflection roller 1 in a dancer roller assembly 85.

The rubber tire component 9 is a substantially continuous, strip-like element that is supplied from an upstream station, e.g. an extruder, or a storage reel. The rubber tire component 9 is shown in cross section in FIG. 2. In this exemplary embodiment, the rubber tire component 9 comprises a body of rubber material 90 and a plurality of reinforcement cords 91 embedded in said body of rubber material 90. The body of rubber material 90 has a main surface 92 facing towards and contacting the deflection roller 1 in a manner which will be described hereafter in more detail.

As shown in FIGS. 1-3, the deflection roller 1 comprises a central axle or shaft 2 that defines an axis of rotation S of the deflection roller 1, an axial direction A parallel to, in-line with or along the axis of rotation S and a radial direction R. In the context of the invention, 'radially' is not intended to mean strictly orthogonal to the axis of rotation S, but is to interpreted as extending in a radial manner outward or away from a center, in this case the axis of rotation S. The shaft 2 is hollow or tubular to allow for the deflection roller 1 to be rotatably mounted on a shaft of the tire building machine (not shown). Alternatively, the shaft 2 may protrude towards the tire building machine, with the tire building machine being provided with suitable receptacles (not shown) for rotatably receiving the shaft 2.

The deflection roller 1 is provided with a plurality of bristles 3 which are distributed evenly in a circumferential direction around the axis of rotation S. All of the plurality of bristles 3 are of the same or substantially the same length so that the distal or free ends thereof in the radial direction R together form a circumferential brush surface 4 for supporting the rubber tire component 9 thereon. The circumferential brush surface 4 extends concentrically to the axis of rotation S at a first diameter D1. As shown in cross section in FIGS. 2 and 3, the deflection roller 1 is provided with a bristle holder 5 for holding and positioning the plurality of bristles 3 with respect to the shaft 2. Each bristle 3 of the plurality of bristles 3 is mounted orthogonally with respect to the axis of rotation S to the bristle holder 5 such that at least the radially inner part of the bristles 3, proximal to the bristle holder 5, extends orthogonal to or substantially orthogonal to the axis of rotation S. The bristles 3 are given a neutral orientation with respect to the axis of rotation, e.g. each bristle 3 extending in a plane that is at a right angle with respect to the axis of rotation. Preferably, in an unbend or unflexed state, each bristle 3 extends outwards in the radial direction R orthogonally or substantially orthogonally with respect to the axis of rotation S. The bristles 3 in this exemplary embodiment extend neutrally orthogonally outward and are not given a specific oblique orientation or offset with respect to the orthogonal direction. The bristles 3 are thus only arranged for passively supporting the rubber tire component 9 without actively steering it in the axial direction A.

The bristles 3 of the plurality of bristles 3 are strong enough or stiff enough in the radial direction R for in combination supporting the rubber tire component 9 around the circumferential brush surface 4 in a stable manner at or near the first diameter D1. Each bristle 3 of the plurality of bristles 3 is however flexible enough in the axial direction A to individually and at least partially move with the rubber tire component 9 in the axial direction A in the event that the rubber tire component 9 is displaced or runs out of alignment in said axial direction A with respect to the deflection roller 1. As such, the bristles 3 do not cause or considerably reduce the amount of friction between the rubber tire component 9 and the circumferential brush surface 4 in the axial direction A in the event that the rubber tire component 9 starts to run out of alignment in the axial direction A with respect deflection roller 1. The bristles 3 are resiliently flexible, in the sense that they in normal use only bent or flex within their elastic range and return to the unbend or unflexed state as soon as the force that causes the bending or flexing is removed. In practice, this means that the bristles 3 will move with the tire component 9 in the axial direction A as long as the bristles 3 are in contact with the main surface 92 of the rubber tire component 9, but as soon as the contact is terminated, each bristle 3 will immediately and/or individually return to its respective unbend or unflexed state.

As shown in FIGS. 1-3, the deflection roller 1 further comprises a first boundary element 6 and a second boundary element 7 that bind or enclose the circumferential brush surface 4 in the axial direction A. The circumferential brush surface 4 extends in the axial direction A in between the first boundary element 6 and the second boundary element 7. As best seen in FIG. 2, the first boundary element 6 extends adjacent to the plurality of bristles 3 in the axial direction A and extends radially outwards in the radial direction R to a position outside the circumferential brush surface 4. The first boundary element 6 is provided with a disc-shaped, a disc-like body or a disc 60 that is concentrically mounted to or with respect to the shaft 2. The disc 60 has a first circumferential edge 61 that extends concentrically with respect to and protrudes radially outside of the circumferential brush surface 4 at a second diameter D2. The disc 60 forms a first boundary surface 62 opposite to the rubber tire component 9 in the axial direction A at a first end of the circumferential brush surface 4. The first boundary surface 6 stands up vertically upright with respect to the circumferential brush surface 4 over a distance that is at least equal to the thickness of the tire component 9 in the radial direction R. In this example, the disc 60 is chamfered above said thickness.

The second boundary element 7 is mirror symmetrical to the first boundary element 6 in a mirror plane perpendicular to the axis of rotation S. As such, the second boundary element 7 also comprises a disc 70 that is concentrically mounted to or with respect to the shaft 2 at a second end of the circumferential brush surface 4 in the axial direction A with respect to the first end and the first boundary element 6. The disc 70 of the second boundary element 7 similarly has a second circumferential edge 71 and a second boundary surface 72 opposite to the rubber tire component 9 in the axial direction A at the second end of the circumferential brush surface 4.

The first boundary element 6 and the second boundary element 7 protrude radially outside the circumferential brush surface 4 from the first diameter D1 up to the second diameter D2 over a protrusion distance X. The protrusion distance X is at least equal to the thickness of the rubber tire component 9 which the deflection roller 1 is arranged to guide and/or deflect. The protrusion distance X in this example is approximately thirty (30) millimeters.

As shown in FIG. 2, the bristle holder 5 is mounted to and extends between the first boundary element 6 and the second boundary element 7 in a position in the radial direction R outside of or spaced apart from the shaft 2. Thus, the bristles 3 do not necessarily have to originate from the shaft 2 but can be supported on or mounted to the bristle holder 5 at a radial distance from the shaft 2, thereby reducing the length of the bristles 3 in the radial direction R between their respective bases and the circumferential brush surface 4.

The operation of the aforementioned deflection roller 1 will now be described with reference to FIGS. 1, 2 and 3.

As described before, the bristles 3 as shown in FIGS. 1, 2 and 3 individually do not generate a significant amount of resistance against movement of the rubber tire component 9 in the axial direction A. The reduced friction between the circumferential brush surface 4 and the rubber tire component 9 as a result of the resilient flexibility of the individual bristles 3 allows for the rubber tire component 9 to run out of alignment with respect to the deflection roller 1 in the axial direction A without severe consequences to the quality or consistency of the rubber tire component 9. In particular, the boundary elements 6, 7 allow for correction of the misalignment of the rubber tire component 9 by simply stopping and/or reversing the movement of rubber tire component 9 in the axial direction A as soon as the rubber tire component 9 hits or starts to abut the boundary surfaces 62, 72 of one of the boundary elements 6, 7.

Again, because of the minimal friction between the circumferential brush surface 4 and the rubber tire component 9, the reaction force alone, as exerted by the one boundary element 6, 7 upon the rubber tire component 9, is enough to stop and/or reverse the movement of the rubber tire component 9 in the axial direction A. During the running out of alignment of the rubber tire component 9 in the axial direction A, the bristles 3 individually come into contact and are eventually individually released out of contact with the rubber tire component 9, which allows the bristles 3 to return to the unbend or unflexed state, ready for renewed contact with the rubber tire component 9 when the continuous length of the rubber tire component 9 start to run out of alignment in the opposite axial direction A.

FIG. 4 shows the festooner 81 and the use of a plurality of the aforementioned deflection rollers 1 in said festooner 81. The festooner 81 comprises an upright column 82 for supporting an upper support member 83 and a lower support member 84. A plurality of the deflection rollers 1 according to FIGS. 1, 2 and 3 is mounted to each of the support members 83, 84 to form a guide path P for the rubber tire component 9 that alternatingly zigzags between the deflection rollers 1 at the upper support member 83 and the lower support member 84. The support members 83, 84 are arranged to be reciprocally moved to and fro each other in a vertical direction along the column 82 to decrease and increase, respectively, the capacity of the festooner 81. At each of the deflection rollers 1, the rubber tire component 9 is deflected around the circumferential brush surface 4 of the respective deflection roller 1 over an angle of at least one-hundred-and-eighty (180) degrees with respect to the axis of rotation S from a first direction of conveyance to an opposite second direction of conveyance. Thus, the main surface 92 of the rubber tire component 9 contacts at least a half circumference of the circumferential brush surface 4.

In particular in situations when the capacity of the festooner is increased or decreased, the rubber tire component 9 is subjected to various forces that could potentially cause the rubber tire component 9 to run out of alignment. The use of a plurality of said deflection roller 1 in a festooner 81 is particularly advantageous as the plurality of deflection rollers 1 are able to automatically correct any running out of alignment of the rubber tire component 9, without significant friction and thus without causing permanent stretching and/or deformation of the rubber tire component 9 or the reinforcement cords 91 embedded in the rubber tire component 9. In particular the occurrence of waving as a result of uneven stretching of the reinforcement cords 91 in the longitudinal direction of the rubber tire component 9 can be reduced or prevented.

FIG. 5 shows a dancer roller assembly 85 and the use of the aforementioned deflection roller 1 as a dancer roller in said dancer roller assembly 85. A dancer roller is typically used in tire building applications just upstream of a station where abrupt changes in the feeding velocity of the rubber tire component 9 are required to accommodate an intermittent process, e.g. at a cutting station where lengths of the rubber tire component 9 are fed onto a cutting table and cut into smaller pieces. The deflection roller 1 in its function as dancer roller is mounted to vertically extending guides 88, 89 and is arranged to rapidly move in an up and down dancing direction E along the guides 88, 89 with respect to a set of stationary rollers 86, 87 to briefly accumulate a length of the rubber tire component 9 in a loop L between the stationary rollers 86, 87 before feeding it downstream. At the deflection roller 1, the rubber tire component 9 is deflected around the circumferential brush surface 4 of the deflection roller 1 over an angle of at least one-hundred-and-eighty (180) degrees with respect to the axis of rotation S from a first direction of conveyance to an opposite second direction of conveyance. Thus, the main surface 92 of the rubber tire component 9 contacts at least a half circumference of the circumferential brush surface 4. The rapid movement can cause running out of alignment of the rubber tire component 9 with respect to the deflection roller 1, which because of the reduced friction can be corrected by the deflection roller 1 without serious deformation and/or stretching of the rubber tire component 9.

Figure 6A:
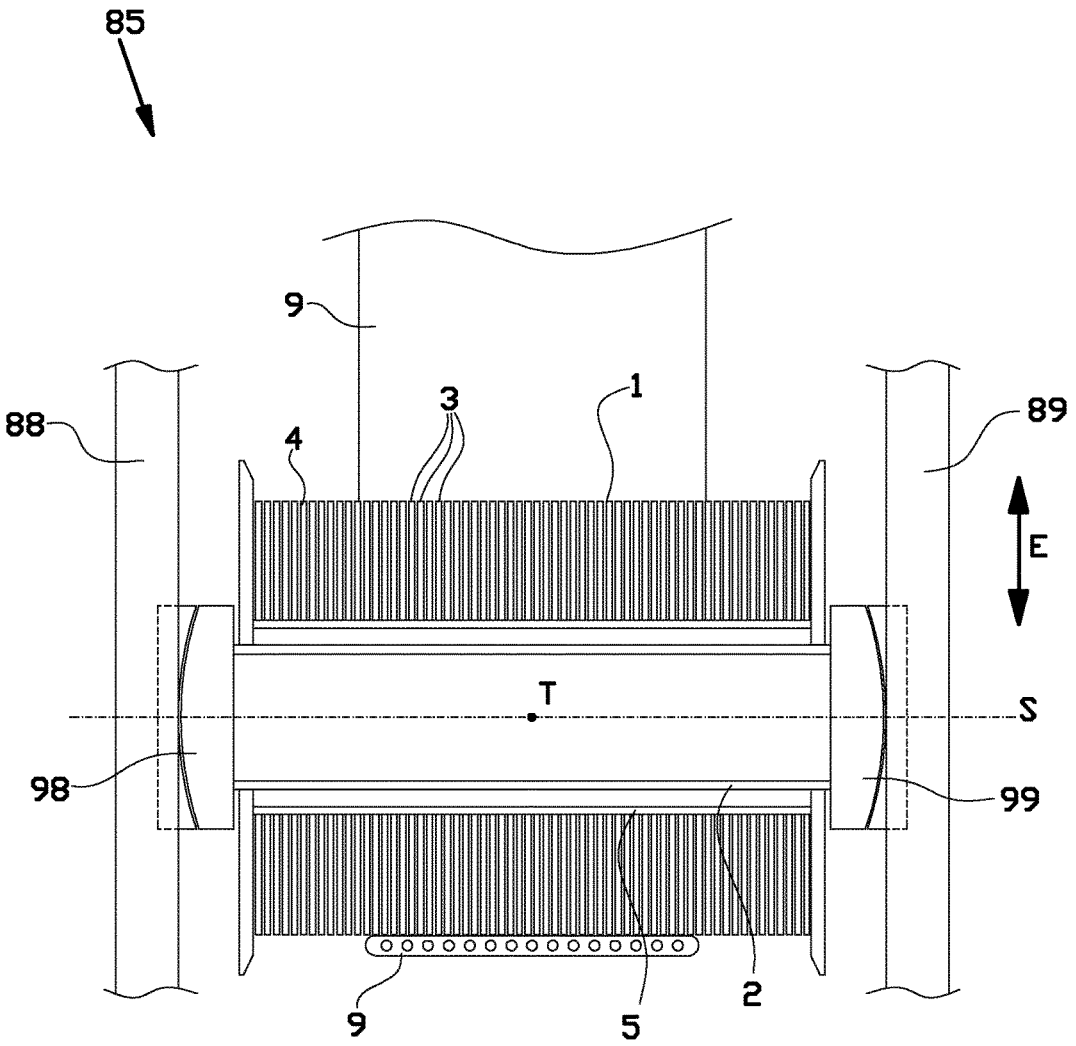
FIGS. 6A and 6B show two steps in the operation of the deflection roller in the dancer roller assembly according to FIG. 5.
Figure 6B:
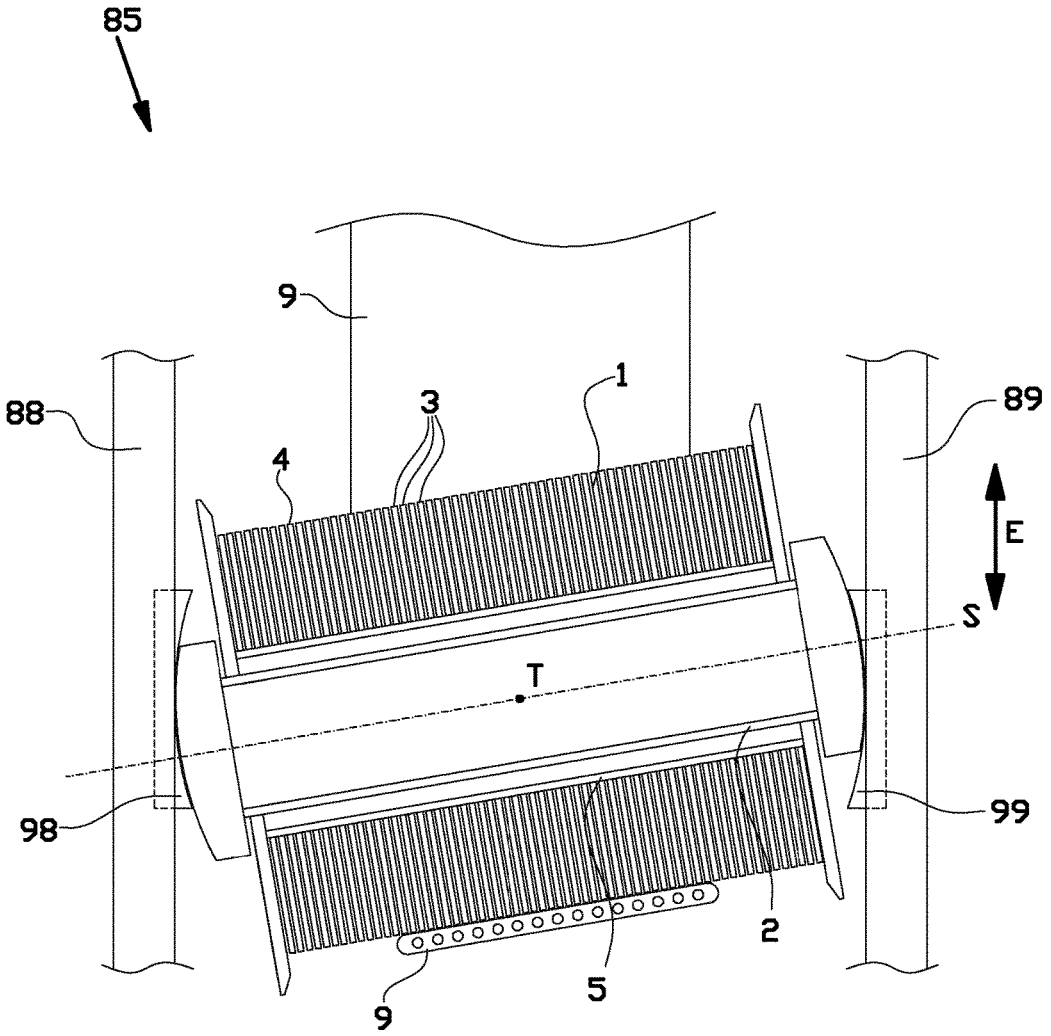

A traditional dancer roller is only movable in the up and down dancing direction E. FIGS. 6A and 6B show a possible configuration of the deflection roller 1 according to the invention, which contrary to the traditional dancer rollers, is tiltable about a tilting axis T, in addition to the up and down movement in the dancing direction E. The tilting axis T extends perpendicular to the axis of rotation S and perpendicular to the dancing direction E of the deflection roller 1. By tilting the deflection roller 1 about the tilting axis T, asymmetries, tilting, warping and/or uneven tensions in the rubber tire component 9 can be compensated for at the deflection roller 1.

As schematically shown in FIGS. 6A and 6B, the shaft 2 of the deflection roller 1 is mounted in a tiltable manner to the guides 88, 89 via a set of concave/convex slidable and/or rotational bearings 98, 99. The concave parts of the bearings 98, 99 are mounted to the guides 88, 89 so as to be slidable up and down in the dancing direction E along the guides 88, 89. The convex parts of the bearings 98, 99 are mounted to the shaft 2 via further rotational bearings to allow rotation of the shaft 2 with respect to the convex parts of the bearings 98, 99 about the rotational axis S. The concave parts of the bearings 98, 99 are concentrically shaped with respect to the tilting axis T, while the convex parts of the bearings 98, 99 are slidably placed or received within the concave parts so as to be tiltable about the tilting axis T. As a result, the deflection roller 1 is rotatable or tiltable about the tilting axis T within a tilting range of approximately zero (0) to fifteen (15) degrees with respect to the neutral or horizontal position. The deflection roller 1 automatically tilts with the rubber tire component 9 and thus effectively follows the rubber tire component 9 when asymmetries, tilting, warping and/or uneven tensions occur in the rubber tire component 9. By having the tiltable deflection roller 1, the risk of the rubber tire component 9 running of the side of the deflection roller 1 can be reduced.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A deflection roller for guiding or deflecting a rubber tire component, wherein the deflection roller comprises a shaft that defines an axis of rotation of the deflection roller and a plurality of bristles distributed circumferentially around the shaft and extending radially outwards and orthogonally with respect to the axis of rotation to form a circumferential brush surface that is concentric to the axis of rotation, wherein the deflection roller further comprises a first boundary element and a second boundary element extending adjacent to the plurality of bristles in an axial direction parallel to the axis of rotation and protruding radially outside the circumferential brush surface at a first end and a second end of the circumferential brush surface, respectively, for binding the circumferential brush surface in the axial direction.

2. The deflection roller according to claim 1, wherein the bristles extend in a substantially neutral orientation that does not actively steer the rubber tire component in an axial direction parallel to the axis of rotation.

3. The deflection roller according to claim 1, wherein the deflection roller comprises a bristle holder for holding and positioning the plurality of bristles with respect to the shaft, wherein the plurality of bristles are mounted orthogonally to the bristle holder.

4. The deflection roller according to claim 1, wherein the bristles of the plurality of bristles are flexible.

5. The deflection roller according to claim 1, wherein the bristles of the plurality of bristles are resilient.

6. The deflection roller according to claim 1, wherein the circumferential brush surface is straight cylindrical or has a constant diameter in the axial direction.

7. The deflection roller according to claim 1, wherein all bristles of the plurality of bristles have the same length.

8. The deflection roller according to claim 1, wherein the first boundary element and the second boundary element comprise a first boundary surface and a second boundary surface, respectively, protruding radially outside the circumferential brush surface in an upright orientation with respect to the circumferential brush surface.

9. The deflection roller according to claim 8, wherein the first boundary surface and the second boundary surface extend circumferentially or concentrically with respect to the circumferential brush surface.

10. The deflection roller according to claim 8, wherein the first boundary element and the second boundary element comprise a first disc forming the first boundary surface and a second disc forming the second boundary surface, respectively, each disc having a circumferential edge extending concentrically with respect to and radially outside of the circumferential brush surface.

11. The deflection roller according to claim 1, wherein the first boundary element and the second boundary element protrude radially outside the circumferential brush surface over a distance that is at least equal to the thickness of the rubber tire component which the deflection roller is arranged to guide or deflect.

12. The deflection roller according to claim 1, wherein the first boundary element and the second boundary element protrude radially outside the circumferential brush surface over at least ten millimeters at least twenty millimeters or at least thirty millimeters.

13. The deflection roller according to claim 1, wherein the first boundary element and the second boundary element are mounted to the shaft.

14. The deflection roller according to claim 13, wherein the deflection roller comprises a bristle holder for holding and positioning the plurality of bristles with respect to the shaft, wherein the plurality of bristles are mounted orthogonally to the bristle holder, wherein the bristle holder is mounted to and extends between the first boundary element and the second boundary element in a position radially outside or spaced apart from the shaft.

15. The deflection roller according to claim 1, wherein the shaft is a hollow shaft or a tube.

16. A tire building machine comprising the deflection roller according to claim 1.

17. The tire building machine according to claim 16, wherein the tire building machine comprises a festooner, wherein festooner comprises a plurality of said deflection rollers.

18. The tire building machine according to claim 16, wherein the tire building machine comprises a dancer roller assembly, wherein the deflection roller is a dancer roller of said dancer roller assembly.

19. The tire building machine according to claim 18, wherein the dancer roller assembly comprises guides, wherein the deflection roller is slidable along the guides in a dancing direction, wherein the deflection roller is tiltable about a tilting axis that extends perpendicular to the axis of rotation and perpendicular to the dancing direction.

20. A method for guiding or deflecting a rubber tire component from a first direction of conveyance to a second direction of conveyance which is different from the first direction of conveyance, in a tire building machine, while containing the rubber tire component on the circumferential brush surface between the first boundary element and the second boundary element, which comprises providing a deflection roller which comprises a shaft that defines an axis of rotation of the deflection roller and a plurality of bristles distributed circumferentially around the shaft and extending radially outwards and orthogonally with respect to the axis of rotation to form a circumferential brush surface that is concentric to the axis of rotation, wherein the deflection roller further comprises a first boundary element and a second boundary element extending adjacent to the plurality of bristles in an axial direction parallel to the axis of rotation and protruding radially outside the circumferential brush surface at a first end and a second end of the circumferential brush surface, respectively, for binding the circumferential brush surface in the axial direction, and guiding or deflecting the rubber tire component using the deflection roller.

* * * * *